US009816503B2

(12) United States Patent
Suhara

(10) Patent No.: US 9,816,503 B2
(45) Date of Patent: Nov. 14, 2017

(54) UNIAXIAL ECCENTRIC SCREW PUMP

(71) Applicant: HEISHIN LTD., Kobe-shi, Hyogo (JP)

(72) Inventor: Nobuhisa Suhara, Kobe (JP)

(73) Assignee: HEISHIN LTD., Kobe-shi (JP)

( * ) Notice: Subject to any disclaimer, the term of this patent is extended or adjusted under 35 U.S.C. 154(b) by 58 days.

(21) Appl. No.: 14/893,010

(22) PCT Filed: May 19, 2014

(86) PCT No.: PCT/JP2014/063234
§ 371 (c)(1),
(2) Date: Nov. 20, 2015

(87) PCT Pub. No.: WO2014/189013
PCT Pub. Date: Nov. 27, 2014

(65) Prior Publication Data

US 2016/0102664 A1 Apr. 14, 2016

(30) Foreign Application Priority Data

May 21, 2013 (JP) ..... 2013-107250

(51) Int. Cl.
*F01C 1/10* (2006.01)
*F03C 2/00* (2006.01)
(Continued)

(52) U.S. Cl.
CPC ..... *F04C 15/0065* (2013.01); *F04C 2/107* (2013.01); *F04C 2/1071* (2013.01);
(Continued)

(58) Field of Classification Search
CPC F04C 15/0065; F04C 15/0061; F04C 15/008; F04C 2/107; F04C 2/1071; F04C 2/1073; F04C 2/1075
(Continued)

(56) References Cited

U.S. PATENT DOCUMENTS

2010/0040498 A1 2/2010 Akamatsu
2010/0239446 A1 9/2010 Ree

FOREIGN PATENT DOCUMENTS

JP 2008-223492 A 9/2008
JP 2009-047061 A 3/2009
(Continued)

OTHER PUBLICATIONS

ISA/JP, International Search Report dated Aug. 19, 2014 in International Application No. PCT/JP2014/063234, total 2 pages including translation.

*Primary Examiner* — Theresa Trieu
(74) *Attorney, Agent, or Firm* — Masuvalley & Partners

(57) ABSTRACT

A uniaxial eccentric screw pump for rotating a rotor about its axis and revolving the rotor without involving complicated operations and control is provided. The uniaxial eccentric screw pump includes a rotor drive mechanism capable of revolving a rotor while rotating the rotor about its axis. The rotor drive mechanism includes a rotation power transmission member rotatable about a predetermined center axis, and a revolution track formation member capable of revolving a proximal shaft portion of the rotor while allowing rotation of the proximal shaft portion about its axis. The rotor drive mechanism distributes power output from the same motor in parallel and transmit the power to the rotation power transmission member and the revolution track formation member, enabling the rotation power transmission member and the revolution track formation member to rotate about their axes while being synchronized mechanically, and enabling the rotor to revolve while rotating about its axis.

4 Claims, 4 Drawing Sheets

(51) Int. Cl.

| | |
|---|---|
| ***F03C 4/00*** | (2006.01) |
| ***F04C 2/00*** | (2006.01) |
| ***F04C 15/00*** | (2006.01) |
| ***F04C 2/107*** | (2006.01) |

(52) U.S. Cl.
CPC ..... *F04C 2/1073* (2013.01); *F04C 15/008* (2013.01); *F04C 15/0061* (2013.01)

(58) Field of Classification Search
USPC ..... 418/48, 152, 182
See application file for complete search history.

(56) References Cited

FOREIGN PATENT DOCUMENTS

| | | | |
|---|---|---|---|
| JP | 2012-154215 | A | 8/2012 |
| JP | 5070515 | B2 | 11/2012 |
| WO | 2006/123927 | A1 | 11/2006 |

UNIAXIAL ECCENTRIC SCREW PUMP

This application is the U.S. National Phase of International Patent Application No. PCT/JP2014/063234 filed on May 19, 2014, entitled "Uniaxial Eccentric Screw Pump (as translated)," and claims priority to Japanese Application No. JP2013-107250 filed on May 21, 2013, which are hereby expressly incorporated by reference in their entirety for all purposes.

TECHNICAL FIELD

The present invention relates to a uniaxial eccentric screw pump including a rotor drive mechanism capable of revolving a rotor while rotating the rotor about its axis.

BACKGROUND OF THE DISCLOSURE

Hitherto, uniaxial eccentric screw pumps as disclosed in Patent Literatures 1 to 3 have been provided. In the uniaxial eccentric screw pump disclosed in Patent Literature 1 (JP 2012-154215 A), a rotor constructing a pump mechanism is connected to a power source through intermediation of a coupling rod. Thus, the rotor is revolvable (rotatable eccentrically) while being rotated about its axis.

Further, in the uniaxial eccentric screw pump disclosed in Patent Literature 2 (JP 5070515 B2), a rotor drive mechanism is provided between a power source side and a rotor, to thereby allow rotation of the rotor about its axis and revolution of the rotor. The rotor drive mechanism used in this uniaxial eccentric screw pump is a so-called planetary gearing mechanism or other such mechanism.

Further, in the uniaxial eccentric screw pump disclosed in Patent Literature 3 (JP 2009-047061 A), a rotation speed control driving portion for rotating a rotor about its axis and a revolution speed control driving portion for revolving the rotor are provided independently of each other. In this uniaxial eccentric screw pump, control of synchronizing operations of respective motors serving as the rotation speed control driving portion and the revolution speed control driving portion is executed, to thereby revolve the rotor while rotating the rotor about its axis.

In the above-mentioned related-art uniaxial eccentric screw pumps of Patent Literature 1 and Patent Literature 3, it is necessary to provide an elongated rod such as the coupling rod. For this reason, the related-art uniaxial eccentric screw pumps have a problem in that the total length is increased and the uniaxial eccentric screw pump is therefore upsized. Concomitantly with this problem, the related-art uniaxial eccentric screw pumps have another problem in that, when the pumping of fluid is stopped, the amount of fluid remaining in a pump casing is increased.

Further, when the independent drive sources are provided as the drive source for rotating the rotor about its axis and the drive source for revolving the rotor as in the above-mentioned uniaxial eccentric screw pump of Patent Literature 3, there is a problem in that the apparatus structure and the operation control become complicated accordingly. Similarly, also when the so-called planetary gearing mechanism or other such mechanism is arranged between the power source side and the rotor as the rotor drive mechanism as in the above-mentioned related-art uniaxial eccentric screw pump of Patent Literature 2, there is a problem in that the apparatus structure becomes complicated.

In view of the above, the present invention has an object to provide a uniaxial eccentric screw pump having a simple and compact apparatus structure and being capable of rotating a rotor about its axis and revolving the rotor without involving complicated operation control.

SUMMARY OF THE INVENTION

According to one embodiment of the present invention, which is provided in order to solve the above-mentioned problem, there is provided a uniaxial eccentric screw pump configured such that a rotor of an external screw type is inserted into a stator having an insertion hole of an internal screw type, the uniaxial eccentric screw pump including a rotor drive mechanism capable of revolving the rotor while rotating the rotor about its axis, the rotor drive mechanism including: a rotation power transmission member configured to rotate about a predetermined center axis, to thereby rotate the rotor about its axis; and a revolution track formation member configured to revolve a proximal shaft portion of the rotor along a predetermined revolution track while allowing rotation of the proximal shaft portion about its axis, the rotor drive mechanism being configured to actuate the rotation power transmission member and the revolution track formation member by distributing power output from the same power source in parallel and transmitting the power to the rotation power transmission member and the revolution track formation member while mechanically synchronizing the rotation power transmission member and the revolution track formation member, to thereby enable the rotor to be revolved while being rotated about its axis.

In this embodiment, the uniaxial eccentric screw pump may include the rotor drive mechanism capable of revolving the rotor while rotating the rotor about its axis. Thus, in the uniaxial eccentric screw pump of the present invention, there is no need to provide an elongated rod such as a coupling rod, which is used in the related art for connecting the rotor to the power source so that the rotor is revolvable while being rotated about its axis. Accordingly, the total length of the uniaxial eccentric screw pump can be reduced. Thus, it becomes possible to provide a uniaxial eccentric screw pump having a compact structure reduced in total length. Further, it becomes possible to minimize the amount of fluid remaining inside the uniaxial eccentric screw pump when the uniaxial eccentric screw pump is stopped.

Moreover, in the uniaxial eccentric screw pump, in accordance with the first embodiment of the present invention, the power output from the same power source can be distributed in parallel and input to the rotation power transmission member and the revolution track formation member each constructing the rotor drive mechanism. In addition, when the power is applied, the rotation power transmission member and the revolution track formation member are actuated while being synchronized mechanically. Accordingly, the rotor can be revolved while being rotated about its axis without performing special control or the like, thereby being capable of exerting the pump function. Thus, according to this embodiment, the operation control for driving the rotor and the apparatus structure can be simplified in the uniaxial eccentric screw pump.

In a preferred embodiment, the rotor drive mechanism may include: a rotation-side power transmission line formed so as to enable power transmission from the same power source toward the rotation power transmission member in a single stage or multiple stages; and a revolution-side power transmission line formed so as to enable power transmission from the same power source toward the revolution track formation member in a single stage or multiple stages, and that a number of stages of the rotation-side power transmission line and a number of stages of the revolution-side power transmission line be equal to each other.

In the preferred embodiment, the structure and the operation control of the uniaxial eccentric screw pump can be simplified.

In another embodiment, the rotor drive mechanism may include: an input-side bevel gear connected to a rotational shaft of the same power source; a revolution-side bevel gear coupled to the revolution track formation member; and a rotation-side bevel gear coupled to the rotation power transmission member, and that the revolution-side bevel gear and the rotation-side bevel gear each mesh with the input-side bevel gear.

In this embodiment, the power output from the power source is mechanically distributed from the input-side bevel gear to each of the revolution-side bevel gear and the rotation-side bevel gear, thereby being capable of interlocking the rotation power transmission member and the revolution track formation member securely and smoothly. Thus, in the uniaxial eccentric screw pump of the one embodiment of the present invention, the rotor can be revolved while being rotated about its axis without performing, for example, control of synchronizing the operations of the rotation power transmission member and the revolution track formation member.

In a preferred mode of this embodiment, an outer diameter of at least one of the revolution-side bevel gear or the rotation-side bevel gear are larger than an outer diameter of the revolution track formation member or the rotation power transmission member to which the at least one of the revolution-side bevel gear or the rotation-side bevel gear is coupled.

In this preferred embodiment, the torque transmission efficiency to each of the revolution track formation member and the rotation power transmission member can be enhanced.

In yet another embodiment, the proximal shaft portion and the rotation power transmission member are connected to each other through intermediation of a power transmission unit, and that the power transmission unit is capable of rotating the proximal shaft portion about its axis by transmitting the rotation of the rotation power transmission member to the proximal shaft portion while allowing the revolution of the proximal shaft portion.

In this embodiment, the rotor can smoothly be revolved while being rotated about its axis.

As the above-mentioned power transmission unit, various devices such as an Oldham joint and a pin-roller joint may be used.

Advantageous Effects of Invention

In accordance with the embodiments of the present invention, it becomes possible to provide the uniaxial eccentric screw pump having a compact structure reduced in total length and being capable of minimizing the amount of fluid remaining inside the uniaxial eccentric screw pump when the operation is stopped.

DETAILED DESCRIPTION OF THE INVENTION

Figure 1:
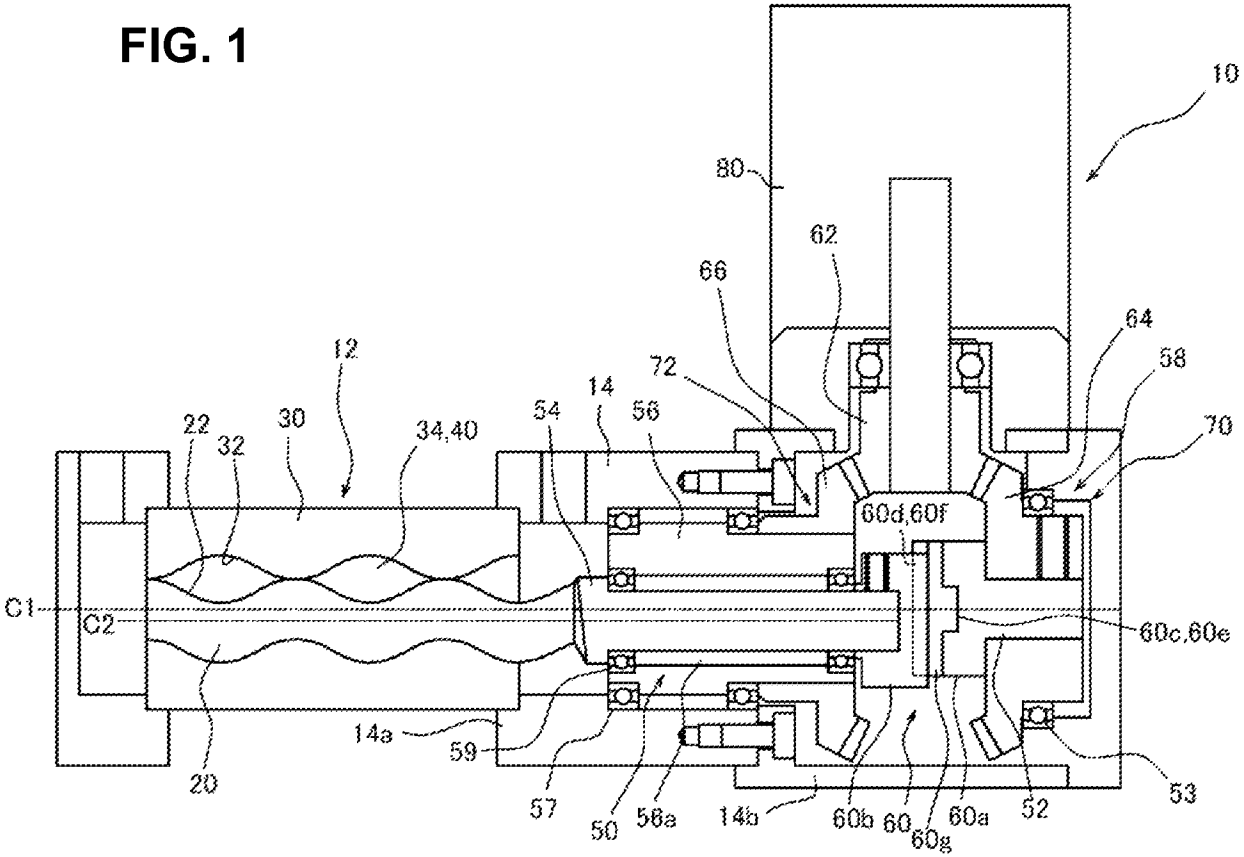
FIG. 1 is a sectional view of an embodiment of a uniaxial eccentric screw pump.

In the following, a uniaxial eccentric screw pump 10 according to the embodiments of the present invention will be described in detail with reference to the drawings. Referring first to FIG. 1, a uniaxial eccentric screw pump 10 which is a rotary displacement pump is shown. As illustrated in FIG. 1, the uniaxial eccentric screw pump 10 may include an external screw-type rotor 20 configured to rotate eccentrically by receiving power, and a stator 30 having an inner peripheral surface formed into an internal screw shape. The uniaxial eccentric screw pump 10 is configured such that a pump mechanism 12 mainly including the rotor 20 and the stator 30 is assembled into a pump casing 14.

The rotor 20 is a metal shaft member formed into an external screw shape with n threads (in this embodiment, n=1). The rotor 20 is formed so that the sectional shape of the rotor 20 is a substantially perfect circle shape in cross section taken at any position in a longitudinal direction of the rotor 20. The stator 30 is a substantially cylindrical member having an inner peripheral surface 32 formed into an internal screw shape with n+1 threads (in this embodiment, n=1). A through-hole 34 of the stator 30 is formed so that the sectional shape (opening shape) of the through-hole 34 is a substantially oval shape in cross section taken at any position in a longitudinal direction of the stator 30.

The rotor 20 is inserted through the through-hole 34 formed in the above-mentioned stator 30, and is freely rotatable eccentrically inside the through-hole 34. The proximal end portion of the rotor 20 is connected to a motor 80 serving as a drive source through intermediation of a rotor drive mechanism 50 described later in detail. The rotor drive mechanism 50 is capable of revolving (eccentrically rotating), with the power input from the motor 80, the rotor 20 while rotating the rotor 20 about its axis.

When the rotor 20 is inserted through the stator 30, an outer peripheral surface 22 of the rotor 20 and the inner peripheral surface 32 of the stator 30 are brought into a close contact state on a tangent line therebetween, to thereby form a fluid transportation path 40 (cavity). The fluid transportation path 40 is formed so as to extend helically in the longitudinal direction of each of the stator 30 and the rotor 20.

The pump casing 14 is roughly divided into a pump mechanism accommodating portion 14*a* and a drive mechanism accommodating portion 14*b*. The pump mechanism accommodating portion 14*a* accommodates the pump mechanism 12 being a tubular member having a cylindrical shape in its outer appearance and mainly including the rotor 20 and the stator 30. Further, the drive mechanism accommodating portion 14*b* accommodates the above-mentioned rotor drive mechanism 50.

As described further above, the rotor drive mechanism 50 is a drive mechanism capable of revolving the rotor 20 while rotating the rotor 20 about its axis. The rotor drive mechanism 50 includes a rotation power transmission member 52, a revolution track formation member 56, a gear mechanism unit 58, and a power transmission member 60 (power transmission unit).

The rotation power transmission member 52 is a member configured to rotate about its axis, to thereby rotate the rotor about its axis. More specifically, the rotation power transmission member 52 is a shaft-like member supported by a bearing 53 inside the drive mechanism accommodating portion 14*b* to be rotatable about a predetermined center axis C1. The rotation power transmission member 52 is connected to a proximal shaft portion 54 of the rotor 20 through intermediation of the power transmission member 60 so as to enable power transmission. Therefore, the rotor 20 is rotatable about its axis through the rotation of the rotation power transmission member 52 about its axis.

The power transmission member 60 is a member capable of rotating the proximal shaft portion 54 (rotor 20) about its axis by transmitting the rotation of the rotation power transmission member 52 to the proximal shaft portion 54 while allowing the revolution (eccentric rotation) of the proximal shaft portion 54. In this embodiment, an Oldham joint is used as the power transmission member 60. That is, the power transmission member 60 connects the rotation power transmission member 52 and the proximal shaft portion 54 with such a structure that grooves 60*c* and 60*d* orthogonal to each other are formed in circular plates 60*a* and 60*b* provided to the end portions of the rotation power transmission member 52 and the proximal shaft portion 54, respectively, and a circular plate-like middle disc 60*g* having projections 60*e* and 60*f* formed on its front and back surfaces to extend in directions orthogonal to each other is interposed between the circular plates 60*a* and 60*b*.

Figure 2:
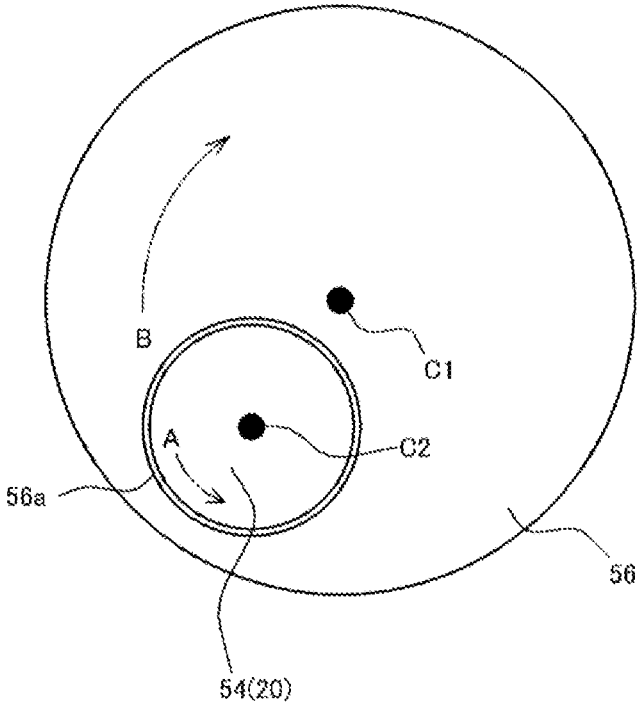
FIG. 2 is a sectional view of a state in which a proximal shaft portion of a rotor is inserted through a revolution track formation member in the embodiment illustrated in FIG. 1.

The revolution track formation member 56 is a member for revolving the proximal shaft portion 54 of the rotor 20 along a predetermined revolution track (see the arrow B of FIG. 2) while allowing the rotation of the proximal shaft portion 54 about its axis (see the arrow A of FIG. 2). More specifically, as illustrated in FIG. 1, the revolution track formation member 56 is a tubular member supported in a freely rotatable manner by a bearing 57 inside the drive mechanism accommodating portion 14*b*. The revolution track formation member 56 has an insertion hole 56*a*, and is capable of supporting the proximal shaft portion 54 through intermediation of a bearing 59 inside the insertion hole 56*a* so that the proximal shaft portion 54 is rotatable (about its axis). Therefore, the proximal shaft portion 54 inserted through the insertion hole 56*a* is freely rotatable about its axis.

Further, as illustrated in FIG. 2, the insertion hole 56*a* is a circular hole formed at a position spaced away from the position of the axis of the revolution track formation member 56. Thus, as illustrated in FIG. 2, the proximal shaft portion 54 is rotatable about a center axis C2 offset from the center axis C1. Further, through the rotation of the revolution track formation member 56 about its axis as indicated by the arrow B in FIG. 2, the proximal shaft portion 54 inserted through the insertion hole 56*a* can be guided so as to be revolved (rotated eccentrically). Thus, the proximal shaft portion 54 is revolvable about the center axis C1 while being rotated about the center axis C2.

The gear mechanism unit 58 includes an input-side bevel gear 62, a rotation-side bevel gear 64, and a revolution-side bevel gear 66. The input-side bevel gear 62 is a bevel gear connected to a rotational shaft of the motor 80 serving as the power source. The input-side bevel gear 62 is arranged so that its rotational axis is oriented in a direction intersecting with (in this embodiment, substantially orthogonal to) the rotational axis of each of the rotation power transmission member 52 and the revolution track formation member 56.

The rotation-side bevel gear 64 is a bevel gear coupled to and rotatable integrally with the rotation power transmission member 52. The rotation-side bevel gear 64 is externally fitted to the rotation power transmission member 52. Therefore, the outer diameter of the rotation-side bevel gear 64 is larger than the outer diameter of the rotation power transmission member 52. The rotation-side bevel gear 64 is coupled to the rotation power transmission member 52 so that their rotational axes match with each other.

The revolution-side bevel gear 66 is a bevel gear coupled to one axial end side of the above-mentioned revolution track formation member 56 and rotatable integrally with the revolution track formation member 56. The revolution-side bevel gear 66 is externally fitted to the revolution track formation member 56. Therefore, the outer diameter of the revolution-side bevel gear 66 is larger than the outer diameter of the revolution track formation member 56. The revolution-side bevel gear 66 is coupled to the revolution track formation member 56 so that their rotational axes match with each other.

The above-mentioned rotation-side bevel gear 64 and the above-mentioned revolution-side bevel gear 66 each mesh with the input-side bevel gear 62. Therefore, when the power is input to the input-side bevel gear 62 along with the drive of the motor 80, the power is distributed in parallel and transmitted to the rotation power transmission member 52 and the revolution track formation member 56 via the rotation-side bevel gear 64 and the revolution-side bevel gear 66, respectively. That is, the power is branched in parallel and transmitted to two lines, which are a rotation-side power transmission line 70 for transmitting the power from the motor toward the rotation power transmission member 52 and a revolution-side power transmission line 72 for transmitting the power from the motor 80 toward the revolution track formation member 56. Further, through the actuation of the input-side bevel gear 62, the rotation-side bevel gear 64 and the revolution-side bevel gear 66 can be actuated while being synchronized mechanically.

The rotation-side power transmission line 70 is a single-stage power transmission line for transmitting the power transmitted from the input-side bevel gear 62 to the rotation power transmission member 52 via the rotation-side bevel gear 64. Further, the revolution-side power transmission line 72 is a single-stage power transmission line for transmitting the power transmitted from the input-side bevel gear 62 to the revolution track formation member 56 via the revolution-side bevel gear 66. Thus, the number of stages of the rotation-side power transmission line 70 for power transmission and the number of stages of the revolution-side power transmission line 72 for power transmission are minimum and equal to each other.

Through the transmission of the rotational power of the motor 80 via the above-mentioned rotation-side power transmission line 70, the rotation power transmission member 52 can be rotated about its axis. Thus, the proximal shaft portion 54 and the rotor 20 connected to the rotation power transmission member 52 through intermediation of the power transmission member 60 can be rotated about their axes. Further, through the transmission of the power of the motor 80 via the revolution-side power transmission line 72, the revolution track formation member 56 can be rotated about its axis. Thus, the proximal shaft portion 54 (rotor 20) can be rotated eccentrically.

Next, an operation of the uniaxial eccentric screw pump 10 is described. The uniaxial eccentric screw pump 10 is configured to rotate the rotor 20 inside the through-hole 34 of the stator 30, to thereby advance the fluid transportation path 40 in its longitudinal direction inside the stator 30. Therefore, through the rotation of the rotor 20, a viscous liquid can be sucked into the fluid transportation path 40 from one end side of the stator 30 and transported toward the other end side of the stator 30. Further, through switching of the rotational direction of the rotor 20, the advancing direction of the fluid transportation path 40 can be changed.

In the uniaxial eccentric screw pump 10, the rotor drive mechanism 50 performs a characteristic operation through the actuation of the motor 80. Specifically, when the motor 80 is actuated, the input-side bevel gear 62 constructing the gear mechanism unit 58 is rotated. Along with this rotation, the power is branched in parallel and transmitted to the two lines, which are the rotation-side power transmission line 70 including the rotation-side bevel gear 64 meshing with the input-side bevel gear 62 and the revolution-side power transmission line 72 including the revolution-side bevel gear 66 meshing with the input-side bevel gear 62. With the power transmitted to the rotation-side power transmission line 70 side, the rotation-side bevel gear 64 and the rotation power transmission member 52 are each rotated about the center axis C1. Along with this rotation, the proximal shaft portion 54 (rotor 20) coupled to the rotation power transmission member 52 through intermediation of the power transmission member 60 is rotated about the center axis C2.

On the other hand, with the power transmitted to the revolution-side power transmission line 72 side, the revolution track formation member 56 is rotated about the center axis C1. Along with this rotation, the proximal shaft portion 54 (rotor 20) inserted through the insertion hole 56*a* formed at the position spaced away from the center axis C1 is revolved (rotated eccentrically) about the center axis C1. Therefore, the proximal shaft portion 54 (rotor 20) performs a revolving operation with the power transmitted from the revolution-side power transmission line 72 side while being rotated about the axis of the proximal shaft portion 54 with the power transmitted from the rotation-side power transmission line side. Through the operation of the rotor 20 inside the through-hole 34 of the stator 30 in this manner, the fluid transportation path 40 is advanced in its longitudinal direction inside the stator 30, thereby being capable of pumping the fluid.

As described above, the uniaxial eccentric screw pump 10 of this embodiment includes the rotor drive mechanism 50, thereby being capable of revolving the rotor 20 while rotating the rotor 20 about its axis. Thus, there is no need to provide an elongated rod such as a so-called coupling rod so as to allow the eccentric rotation of the rotor 20. Accordingly, the total length of the uniaxial eccentric screw pump 10 can be reduced. Further, along with the reduction in total length of the uniaxial eccentric screw pump 10, the amount of fluid remaining in the pump casing 14 when the pumping operation for the fluid is stopped can be reduced.

Further, in the above-mentioned uniaxial eccentric screw pump 10, the power output from the same motor 80 can be distributed in parallel and input to the rotation power transmission member 52 and the revolution track formation member 56. Accordingly, the operation of rotating the rotor 20 about its axis while rotating the rotor 20 eccentrically is executed smoothly, thereby being capable of exerting an excellent pump function. Thus, in the uniaxial eccentric screw pump 10, there is no need to individually perform operation control for the rotation of the rotor 20 about its axis and operation control for the revolution of the rotor 20. Further, there is no need to prepare independent power sources for rotating the rotor 20 about its axis and revolving the rotor 20, respectively. Thus, according to the uniaxial eccentric screw pump 10, the operation control for driving the rotor 20 and the structure of the uniaxial eccentric screw pump 10 can be simplified.

The above-mentioned uniaxial eccentric screw pump 10 includes the rotation-side power transmission line 70 for transmitting the rotation power to the rotor 20, and the revolution-side power transmission line 72 for transmitting the revolution power to the rotor 20. The numbers of stages of the respective power transmission lines 70 and 72 for power transmission are equal to each other. More specifically, the rotor drive mechanism 50 of the uniaxial eccentric screw pump 10 includes the input-side bevel gear 62 connected to the rotational shaft of the motor 80, the rotation-side bevel gear 64 coupled to the rotation power transmission member 52, and the revolution-side bevel gear 66 coupled to the revolution track formation member 56, and the rotation-side bevel gear 64 and the revolution-side bevel gear 66 each mesh with the input-side bevel gear 62. With this structure, the respective power transmission lines 70 and 72 are simplified, thereby being capable of simplifying the structure and the operation control of the uniaxial eccentric screw pump 10. Further, the power output from the motor 80 is distributed mechanically, thereby being capable of interlocking the rotation power transmission member 52 and the revolution track formation member 56 securely and smoothly. Thus, in the uniaxial eccentric screw pump 10, the rotor 20 can be revolved while being rotated about its axis without performing, for example, control of synchronizing the operations of the rotation power transmission member 52 and the revolution track formation member 56.

In the uniaxial eccentric screw pump 10 of this embodiment, the outer diameters of the rotation-side bevel gear 64 and the revolution-side bevel gear 66 are larger than the outer diameters of the rotation power transmission member 52 and the revolution track formation member 56 to which the bevel gears 64 and 66 are coupled, respectively. Therefore, the uniaxial eccentric screw pump 10 has high torque transmission efficiency from the motor 80 side to each of the rotation power transmission member 52 side and the revolution track formation member 56 side.

Note that, in this embodiment, description is made of the example in which the outer diameters of the rotation-side bevel gear 64 and the revolution-side bevel gear 66 are set larger than the outer diameters of the rotation power transmission member 52 and the revolution track formation member 56, respectively. However, the present invention is not limited thereto. That is, the outer diameter of one or both of the rotation-side bevel gear 64 and the revolution-side bevel gear 66 may be equal to or smaller than the outer diameter of one or both of the rotation power transmission member 52 and the revolution track formation member 56, correspondingly.

In the above-mentioned uniaxial eccentric screw pump 10, the proximal shaft portion 54 and the rotation power transmission member 52 are connected to each other through intermediation of the power transmission member 60 configured by the Oldham joint. Thus, it is possible to rotate the proximal shaft portion 54 about its axis by transmitting the rotation of the rotation power transmission member 52 to the proximal shaft portion 54 while allowing the revolution of the proximal shaft portion 54. With this structure, the proximal shaft portion 54 (rotor 20) can securely and smoothly be revolved while being rotated about its axis along with the power transmission from the rotation power transmission member 52.

Figure 4:
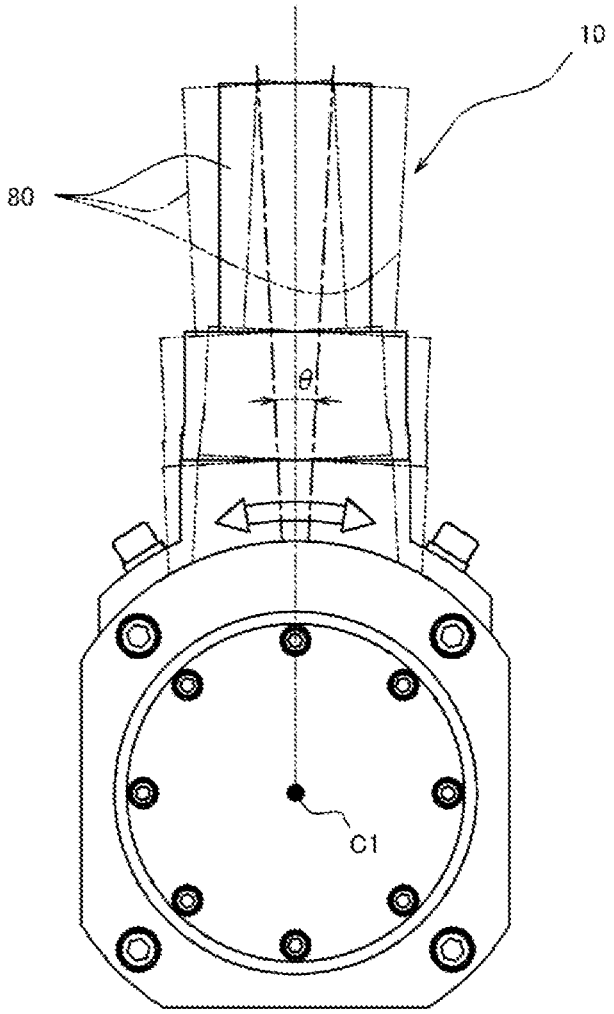
FIG. 4 is a side view of a uniaxial eccentric screw pump configured such that a motor is pivotable when assembling a power transmission member.

Further, as illustrated in FIG. 4, it is preferred to construct the uniaxial eccentric screw pump 10 such that the motor 80 is pivotable about the center axis C1 within a predetermined angle range θ when assembling the power transmission member 60. With this construction, work of meshing each of the rotation-side bevel gear 64 and the revolution-side bevel gear 66 with the input-side bevel gear 62 fixed to the output shaft of the motor 80 can easily be performed at the time of assembling work. As a result, the assembling workability is further enhanced.

Figure 3:
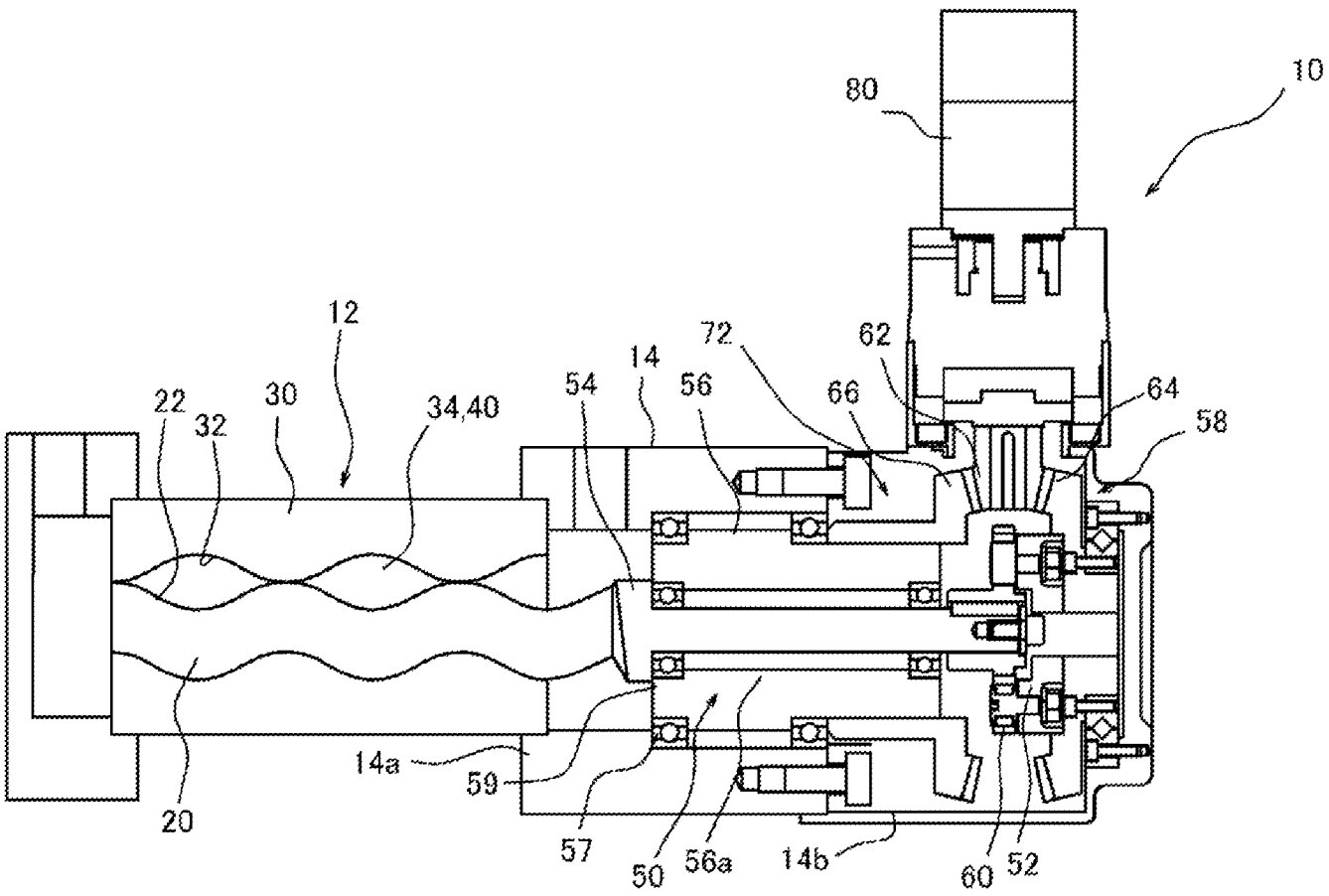
FIG. 3 is a sectional view of a modified example of the uniaxial eccentric screw pump illustrated in FIG. 1.

Note that, in this embodiment, description is made of the example in which the Oldham joint is used as the power transmission member 60. However, the present invention is not limited thereto. That is, the power transmission member 60 may be any device as long as the device is capable of smoothly rotating the proximal shaft portion 54 (rotor 20) about its axis while rotating the proximal shaft portion 54 eccentrically. Specifically, as illustrated in FIG. 3, a pin-roller joint, a pin joint, or other such device may be used as the power transmission member 60.

INDUSTRIAL APPLICABILITY

The present invention is applicable to overall uniaxial eccentric screw pumps each being configured to exert the pump function by revolving (eccentrically rotating) the rotor while rotating the rotor about its axis. In particular, the present invention is suitable for applications in which down-sizing is demanded.

The invention claimed is:

1. A uniaxial eccentric screw pump configured such that a rotor of an external screw type is inserted into a stator having an insertion hole of an internal screw type, the uniaxial eccentric screw pump comprising a rotor drive mechanism revolving the rotor while rotating the rotor about its axis, the rotor drive mechanism comprising:

a rotation power transmission member configured to rotate about a predetermined center axis, to thereby rotate the rotor about its axis; and a revolution track formation member configured to revolve a proximal shaft portion of the rotor along a predetermined revolution track while allowing rotation of the proximal shaft portion about its axis, the rotor drive mechanism being configured to actuate the rotation power transmission member and the revolution track formation member by distributing power output from the same power source in parallel and transmitting the power to the rotation power transmission member and the revolution track formation member while mechanically synchronizing the rotation power transmission member and the revolution track formation member, to thereby enable the rotor to be revolved while being rotated about its axis, wherein the rotor drive mechanism comprises:

a rotation-side power transmission line formed so as to enable power transmission from the same power source toward the rotation power transmission member in a single stage or multiple stages; and a revolution-side power transmission line formed so as to enable power transmission from the same power source toward the revolution track formation member in a single stage or multiple stages, and wherein a number of stages of the rotation-side power transmission line and a number of stages of the revolution-side power transmission line are equal to each other.

2. The uniaxial eccentric screw pump according to claim 1, wherein the rotor drive mechanism further comprising:

an input-side bevel gear connected to a rotational shaft of the same power source;

a revolution-side bevel gear coupled to the revolution track formation member; and a rotation-side bevel gear coupled to the rotation power transmission member, wherein the revolution-side bevel gear and the rotation-side bevel gear each mesh with the input-side bevel gear.

3. The uniaxial eccentric screw pump according to claim 2, wherein an outer diameter of at least one of the revolution-side bevel gear or the rotation-side bevel gear is larger than an outer diameter of the revolution track formation member or the rotation power transmission member to which the at least one of the revolution-side bevel gear or the rotation-side bevel gear is coupled.

4. The uniaxial eccentric screw pump according to claim 1, wherein the proximal shaft portion and the rotation power transmission member are connected to each other through intermediation of a power transmission unit, and wherein the power transmission unit rotates the proximal shaft portion about its axis by transmitting the rotation of the rotation power transmission member to the proximal shaft portion while allowing the revolution of the proximal shaft portion.

* * * * *